United States Patent [19]

Hughes et al.

[11] 3,978,694

[45] Sept. 7, 1976

[54] VAPOR SAVING AMBIENT AIR INTAKE SYSTEM FOR A DRY CLEANER

[75] Inventors: John D. Hughes, Murrysville, Pa.; Al W. Klingensmith, Mansfred, Ohio

[73] Assignee: White-Westinghouse Corporation, Cleveland, Ohio

[22] Filed: Sept. 29, 1975

[21] Appl. No.: 617,850

Related U.S. Application Data

[62] Division of Ser. No. 445,501, Feb. 25, 1974, Pat. No. 3,937,043.

[52] U.S. Cl. ..... 68/18 R

[51] Int. Cl.[2] ..... D06F 43/02; D06F 43/08

[58] Field of Search ..... 68/18 R, 18 C, 18 F, 68/20, 13 R, 209; 34/37

[56] References Cited

UNITED STATES PATENTS

| | | | |
|---|---|---|---|
| 2,574,251 | 11/1951 | Dinley | 68/209 X |
| 3,206,950 | 9/1965 | Xeros | 68/18 R X |
| 3,270,530 | 9/1966 | Czech | 68/18 R |

*Primary Examiner*—Philip R. Coe

*Attorney, Agent, or Firm*—NcNenny, Pearne, Gordon, Gail, Dickinson & Schiller

[57] ABSTRACT

An ambient air intake system for a dry cleaner is disclosed which draws room air through the access opening when the door to the machine is open and vents this air to an outlet without passing it through the interior tubs which contain residual solvent vapor laden air. To accomplish this an air duct is interposed between the access opening of the cabinet housing the dry cleaner and the open end of the interior tubs, with the duct effectively sealed about the periphery of the cabinet opening and the open end of the outer tub and having aligned openings therethrough to define a passageway through which the clothes are inserted and removed. The duct is connected to an electrically actuated normally closed valve which in turn is connected to the inlet of a motor driven fan, the outlet side of which leads to an exhaust pipe. Both the valve and the fan are energized by a door switch when the door associated with the access opening is opened to draw ambient air into the accessed opening, then immediately into the air duct to be exhausted without passing into the interior of the tubs. This minimizes the commingling of the ambient air and the vapor laden air within the tubs to reduce the loss of solvent when the access door is opened.

4 Claims, 4 Drawing Figures

VAPOR SAVING AMBIENT AIR INTAKE SYSTEM FOR A DRY CLEANER

CROSS REFERENCE TO RELATED APPLICATIONS

This is a division of application Ser. No. 445,501, filed Feb. 25, 1974, now U.S. Pat. No. 3,937,043.

This application contains, in its description, matter common to co-pending cases Application Ser. Nos. 445,028, 445,503 and 445,504, of common assignee with the present application.

BACKGROUND OF THE INVENTION

1. Field of the Invention

This invention relates to an air flow system for a dry cleaner for inducing ambient air to flow into the access opening of the machine whenever the door is opened. Such systems have previously been referred to as air exhaust systems; however, the present invention is particularly adapted to provide the air flow without exhausting the tubs.

2. Description of the Prior Art

As a safety feature in dry cleaning machines, an air flow system is provided for drawing ambient or room air in through the access opening to the interior of the machine whenever the door to the machine is opened. This air flow minimizes the escape of toxic solvent vapors out the access opening so that the user will not be subjected to such vapors when loading or unloading clothes from the machine. Heretofore, this air flow was commonly induced by the fan or blower which also was used during the drying cycle to circulate heat through the tubs. Also, to some extent, there were common ducts for each system with a diverter valve for determining whether the air would flow through the recirculating path or to an exhaust outlet. In machines using a relatively inexpensive solvent having normal volatility, the loss of residual solvent vapors from the interior of the tubs and the common ducts was of limited concern. Thus, the air flow system for inducing ambient air to flow in through the door was typically included in the tubs, exhausting the tubs of the residual solvent vapors therein and thus losing them to the atmosphere.

The use of a cleaning solvent which is substantially more expensive and of greater volitality required, for economic reasons, that the residual solvent vapors remaining in the tubs and air recirculating system at the end of the cleaning cycle not be exhausted to atmosphere but, of necessity, retained within the confines of the machine. However, it remains necessary to induce an air flow in through the access whenever the door to the machine is opened.

SUMMARY OF THE INVENTION

The dry cleaning machine of the present invention provides an air flow system for bringing ambient air into the access opening whenever the door is opened which is exclusive of the air recirculating system and substantially reduces exhausting the residual solvent vapors from the tubs. Thus, a separate intake fan and duct is provided with the duct interposed between the access opening of the machine housing and the open ends of the interior tubs, and includes a normally closed valve so that during normal operation of the machine the separate intake system is isolated from the solvent vapors developed during the cleaning cycle. In response to the access door being opened, the intake fan is energized and the valve is opened so that air is drawn into the access opening and directly into the interposed duct with only that vapor generally immediately adjacent the open end of the tubs commingling with the intake air and lost to atmosphere. However, for the most part, the vapors within the tubs are retained and the loss of solvent is minimized.

DESCRIPTION OF THE PREFERRED EMBODIMENT

Figure 1:
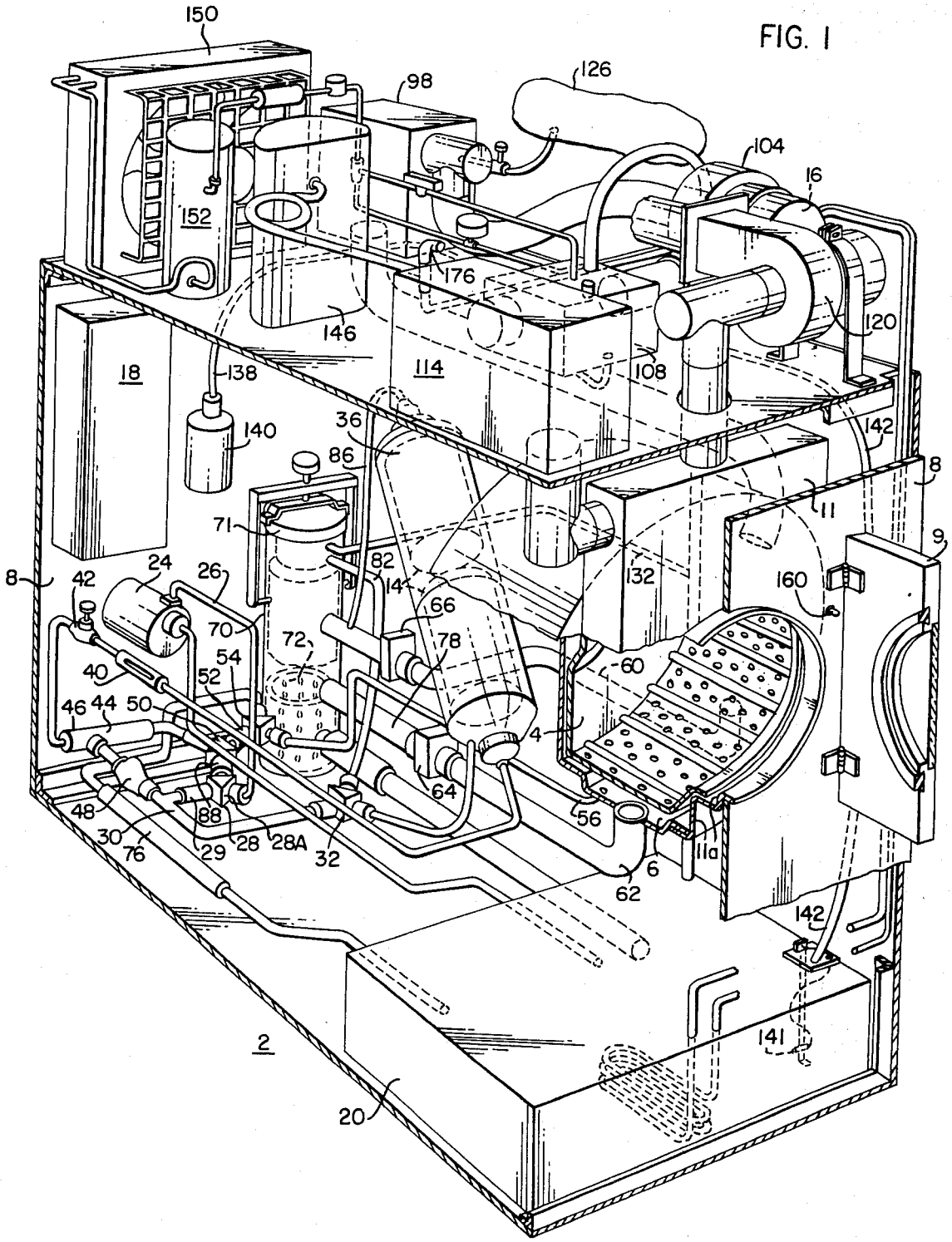
FIG. 1 is a perspective schematic drawing of the dry cleaner primarily showing the solvent distributing system and the air distributing system of the present invention.
Figure 2:
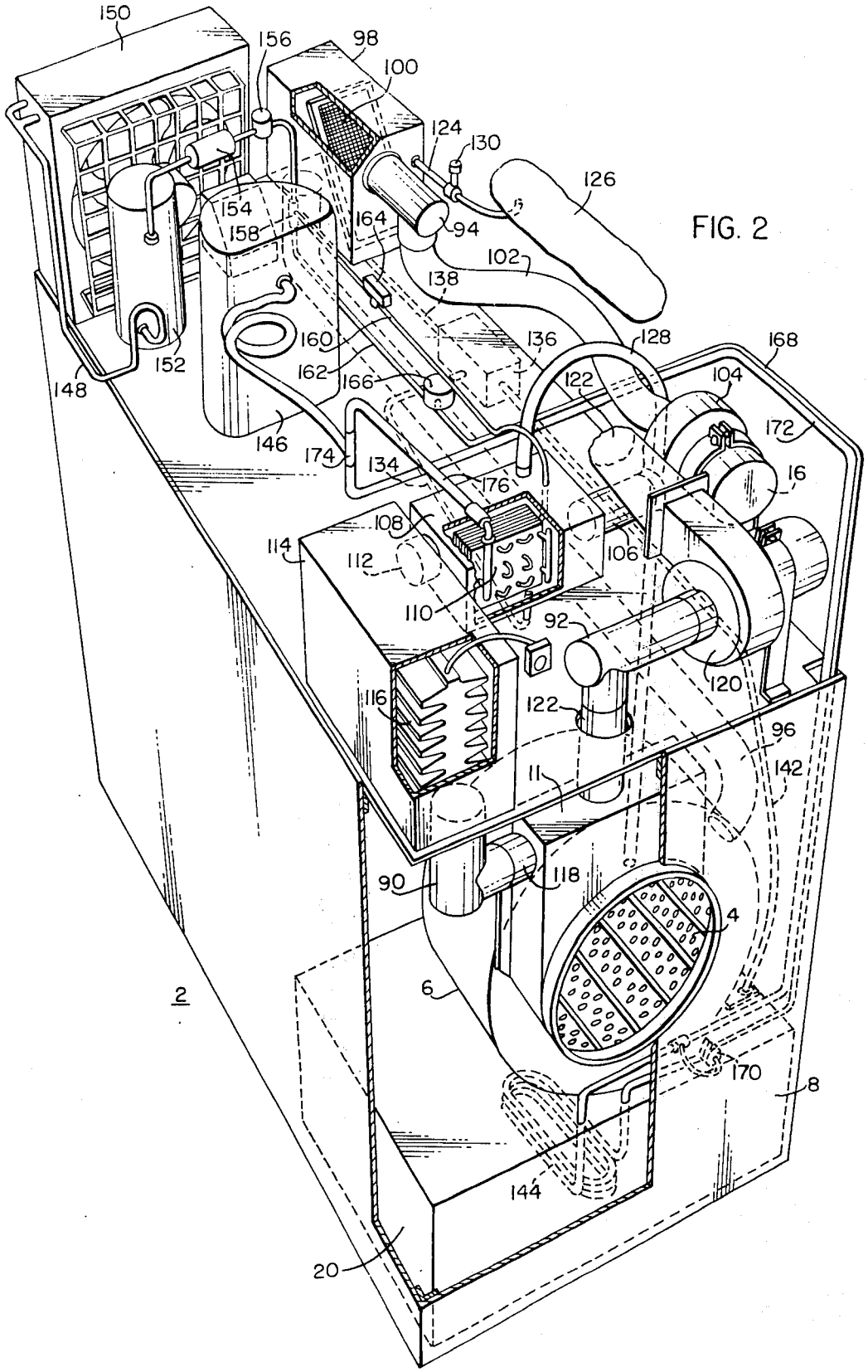
FIG. 2 is a perspective schematic drawing similar to FIG. 1 for primarily showing the air distributing system and a refrigeration system for solvent vapor recovery.

Referring initially to FIGS. 1 and 2 it is seen that the dry cleaner 2 of the present invention is generally of known construction in that it includes a pair of nested tubs 4, 6 having a common horizontal access with the outer tub 6 generally stationarily supported and the inner tub 4 rotatably supported, and an outer cabinet 8 (shown in dotted lines in FIG. 1) having an access opening in alignment with the open end of the tubs and supporting a front opening door 9 for access to the inner tub 4. The cabinet 8 encloses the other operative elements of the dry cleaner such as the drive motor (see FIG. 4) coupled through a well-known belt and pulley drive to the inner tub 4 for either reversibly slowly rotating the tub or spinning the tub at a relatively high speed. Also included is a pump 24 for pumping the dry cleaning solvent from a storage tank 20 into the tub 6 through a filter 14 in the housing 36, and back into the storage tank and a blower 16 for circulating heated air through the tubs for drying the clothes.

The forward concentric openings of the tubs 4 and 6 are spaced from the wall of the cabinet having the opening to accommodate therebetween a header chamber 11. This chamber has opposed walls 11*a* defining concentric openings which in turn are in alignment with the cabinet opening and tub openings respectively to provide an access opening therethrough for the clothes. The walls of the chamber are also sealingly attached to the cabinet structure and outer tub 6, with the periphery of the forward opening bounded by a forwardly extending flange for sealingly engaging the inner face of the door when in a closed position. The upper portion of the chamber above the openings defines a plenum into which the air from the air blower is directed so that it enters the tubs at the forwardmost portion thereof, and also from which exhaust air is drawn as will be explained later.

The complete operation of the electrical components dictating the type of operation being performed is controlled through a well known timer mechanism 18 generally enclosed adjacent the rear of the housing in an area generally inaccessible to the customer/user.

The operative cycle of such a machine, maintained normally in a stand-by condition, includes, after the cleaning cycle is initiated, a washing portion wherein the solvent is delivered to the tub 6 during slow speed rotation thereof so that the clothes are randomly moved about within the solvent, a drain portion wherein the solvent is drained from the tub 6, a spin or centrifuging portion wherein the solvent is extracted from the clothes, and a drying portion when the clothes are again randomly moved about within the tub 4 in the presence of circulating heated air.

The present invention is better described with specific detail to the separate circulating systems within the machine. In this regard each system will be described as it functions through the various distinct portions of the complete cleaning cycle.

SOLVENT FLOW SYSTEM (FIG. 1)

Stand-by

Anytime the machine is not being used it is in a stand-by condition ready for use by merely closing the access door and depositing the appropriate coins. While in the stand-by condition there is no flow of the solvent within the machine, with the solvent being stored in tank 20.

Fill and Wash

After the clothes are loaded into the inner tub 4, the cleaning cycle is initiated, as by closing the access door 9 and depositing the correct change, which energizes the solvent pump 24. This pumps the solvent from the storage tank 20 through pump inlet line 22 into pump 24, hence to discharge pipe 26 and in one side 28A of a diverter valve 28 normally oriented to direct the flow into line 30 through nipple 29.

From line 30 the solvent passes through another diverter valve 32 which normally directs the flow into pipe 34 which is the inlet pipe of a housing 36 enclosing a pair of pleated paper and charcoal filters (not shown). After passing through the filters, the solvent exits the housing through outlet 38 which leads through a sight-glass 40 and manual valve 42 into leg 44 of a T-connector 46. The opposite leg of the T-connector leads to a oneway valve 48 which is set up to prevent flow therethrough from the connector. Thus, the solvent goes to another diverter valve 50 normally directing the flow into yet another diverter valve 54 through a nipple 52. Valve 54 normally directs the flow into pipe 56 which leads into the outer tub 6.

Once the tub 6 fills to a predetermined level, any further solvent coming into the tub causes the solvent to flow out the tub 6 through the overflow line 60. It is to be noted that a drain or dump line 62 also leads from the tub 6, but as this line is closed by a motor drive valve 64 at this time, the solvent can exit the tub only via line 60.

Line 60 also has a motor driven overflow valve 66 which at this time is open permitting flow of the solvent into line 68 connected to a housing 70 containing a button trap (as is well known in the art) enclosing a perforated container 72 interposed between the inlet and the outlet pipe 74 leading back to the storage tank 20.

This recirculation of the solvent from the storage tank through the filters, into the tubs, through the button trap, and back to the tank, is continuous throughout the fill and wash portion of the cycle.

Dump and Spin

At the termination of the wash cycle, although the clothes tub 4 continues to tumble the clothes, the above-described flow circuit is altered to provide two separate solvent flow paths. The first provides continuous filtration of the solvent by continuing to pump the solvent from the tank 20 through the filters via the route described above with the exception being that valve 54 has now been energized and directs the solvent into line 76 which leads directly back to tank 20. Thus, no more solvent enters the tubs. The other path dumps the solvent already in the tubs into the tank 20. This is done by opening valve 64 of line 62 for flow therethrough into another inlet pipe 78 of button basket 72 before flowing through outlet pipe 74 to the storage tank 20. This flow path is maintained all during the drain and subsequent spin portion of the cycle. Also, for purposes of air pressure balance through the solvent distributing system, overflow valve 66 remains open during this portion of the cycle.

Tumble Dry With Heat

During this portion of the cycle the solvent continues to flow through the filtering cycle above described; however, valves 64 and 66 are closed, which in conjunction with valve 54 closing the solvent inlet line to the tub, (as is the case with the filtration flowpath utilized), the solvent flow system is isolated from any evaporative air circulated during the dry cycle.

Last Minute Of The Cycle

During the last minute of the cycle, the solvent which has been flowing in one direction through the filters, is caused to flow through the filters in a reversed direction in an operation known as "backwash". (Again see the U.S. Pat. No. 3,253,431 of common assignee.)

Thus, as before, the solvent is drawn from tank 20 through pipe 22 into pump 24 and discharged to line 26 into valve 28. This diverter valve has now been energized to direct the flow into line 88 and into valve 50 which also has been energized to direct flow into leg 44 of connector 46, thence through manual valve 42, sight-glass 40 and into the outlet 38 of the filter housing 36.

The solvent exits the housing 36 through inlet 34 and into diverter valve 32 which is energized to divert the solvent into line 82 leading to the top of the button tank 70 which, as is also well known, houses a backwash bag which filters particles from the solvent as it passes therethrough into the button basket for return to the tank 20 via line 74.

A filter housing breather line 86 connects the upper end of the filter housing 36 with the button basket tank 70 to bleed any air entrapped therein out of the housing and into a suitable place. Any solvent that may flow therethrough goes directly to the button tank 70 and back to the storage tank 20.

It is important to note that valves 54, 64, and 66 still maintain the solvent distributing system isolated from the circulating drying air.

To complete the solvent flow system, a safety line 132 connects the top of the button tank 70 with a line 128 (a solvent vapor handling line to be explained subsequently) leading directly into storage tank 20. This line 132 accommodates the solvent flow in the event the button trap 70 becomes clogged to the extent that return flow to the tank 20 through line 74 is blocked. Thus, under this condition, the button trap would fill with solvent to the line 132 which would deliver it back to the tank 20 at a rate capable of accommodating the pump capacity during the filtering portion of the cycle.

AIR FLOW SYSTEM (FIG. 2)

As previously explained, the header chamber 11 is attached to the outer tub 6 at the tub's forward opening. This header chamber 11 thus is in air-flow communication with the inner tub 4 through the forward facing opening of the tub. The header chamber has attached thereto a pair of airflow hoses 118 and 122. Another air hose 96 is attached to the stationary outer tub 6 at some point axially remote from the header chamber 59. Each hose in turn is associated with an electrically energized oneway valve 90, 92, and 94 respectively, for controlling the flow through these hoses, these being the only airflow ingress or egress lines connected to the tubs.

Stand-By With Access Door Closed

During this time there is no airflow as no blower is energized and valve 90, 92 and 94 are normally closed. However, should the door become open, a door switch immediately energizes valve 92 and an exhaust blower 120. Thus, it is seen ambient room air is drawn through the front opening and immediately drawn into the upper portion of the header chamber 11 with minimal penetration into the interior of the tubs so that the solvent vapors within the tub are not exhausted while the air is being drawn through the front opening to prevent the user, when loading or unloading clothes, from encountering solvent vapor fumes.

Fill And Wash

Again there is no airflow during this portion of the cleaning cycle as valves 90, 92 and 94 remain closed and no blower is energized. Thus, during this portion of the cycle the solvent in the tub is not exposed to any circulating air.

Drain And Spin

During the drain portion of the cycle, valve 90 associated with the air inlet side of header chamber 59 and valve 94 associated with the air outlet side of the tub 6 are both open to assist in balancing the air pressure throughout the interior of the machine (with no blower being energized) as the solvent is drained from the tubs. However, once the drain portion is completed and the inner clothes tub 4 is energized to spin, all valves 90 and 94 are again closed. This again isolates the air within the tubs and prevents any air circulation through the air distributing system which could be induced by the spinning tub even though no blower was energized if such valves were open.

Elimination of the airflow through the clothes during spin by isolating the tubs as above described is important with respect to minimizing the undesirable phenomena associated with dry cleaning and referred to in the trade as "streaks and swales". These are darker areas in the form of spots and lines that form in the clothes when certain areas dry faster than others and before the solvent has a chance to be distributed generally equally throughout the clothes. Thus, in these areas, generally adjacent the creases or folds in the clothes which are dried quite rapidly, a concentration of non-volatile residue (N.V.R.) carried by the solvent as a result of cleaning the clothes, is present which is highly visible as darker streaks at the interface of the faster dried areas and the subsequently dried area of the clothes.

It logically follows that the greater the volatility of the solvent, i.e. the more readily the solvent vaporizes, the more likely it will be for uneven drying to occur, forming the streaks and swales. The uneven drying as accenuated by the spinning tub, which in addition to maintaining the clothes in a fixed position by virtue of the centrifugal force, also normally induces an air circulation through the tub, created by the high speed spinning of the clothes and tub acting as a blower.

It has been found that the formation of the streaks swales can be greatly reduced and even eliminated by preventing airflow through the tub during the spin cycle. This, in addition to decreasing the vaporization of the solvent from the exposed surfaces of the clothes due to air movement, prevents escape of the vaporized solvent, thereby permitting the vapor pressure within the tub to increase somewhat which itself retards further vaporization. Thus, although a solvent having a higher degree of volatility is used in this machine, the formation of streaks and swales is greatly reduced by having valves 90 and 94 closed during centrifugal extraction.

Tumble Dry With Heat

One minute after the start of the drying portion of the cycle wherein the tub 4 is again reversibly driven at a tumble speed, valves 90 and 94 are opened. This initial minute with the above valves closed permits the clothes to be in a tumbling mode before the flow of drying air is initiated. This is in furtherance of preventing rapid drying of selective areas for eliminating streaks of swales by letting the clothes move randomly about before being subjected to the rapid drying affects of the hot air.

Once the valves 90 and 94 are opened and blower 16 energized, the air and vapor mixture exits the tubs 4, 6 through hose 96 which leads into a lint box 98 having a lint screen 100. After passing through the lint box, air goes through valve 94, and then to hose 102 of the inlet of blower housing 104 enclosing the blower 16. From there the air/vapor mixture goes through hose 106 and into condenser housing 108. Condenser housing 108 contains the evaporator coils 110 of a refrigeration unit (to be described) which condense the solvent vapor from this air and vapor mixture.

Figure 3:
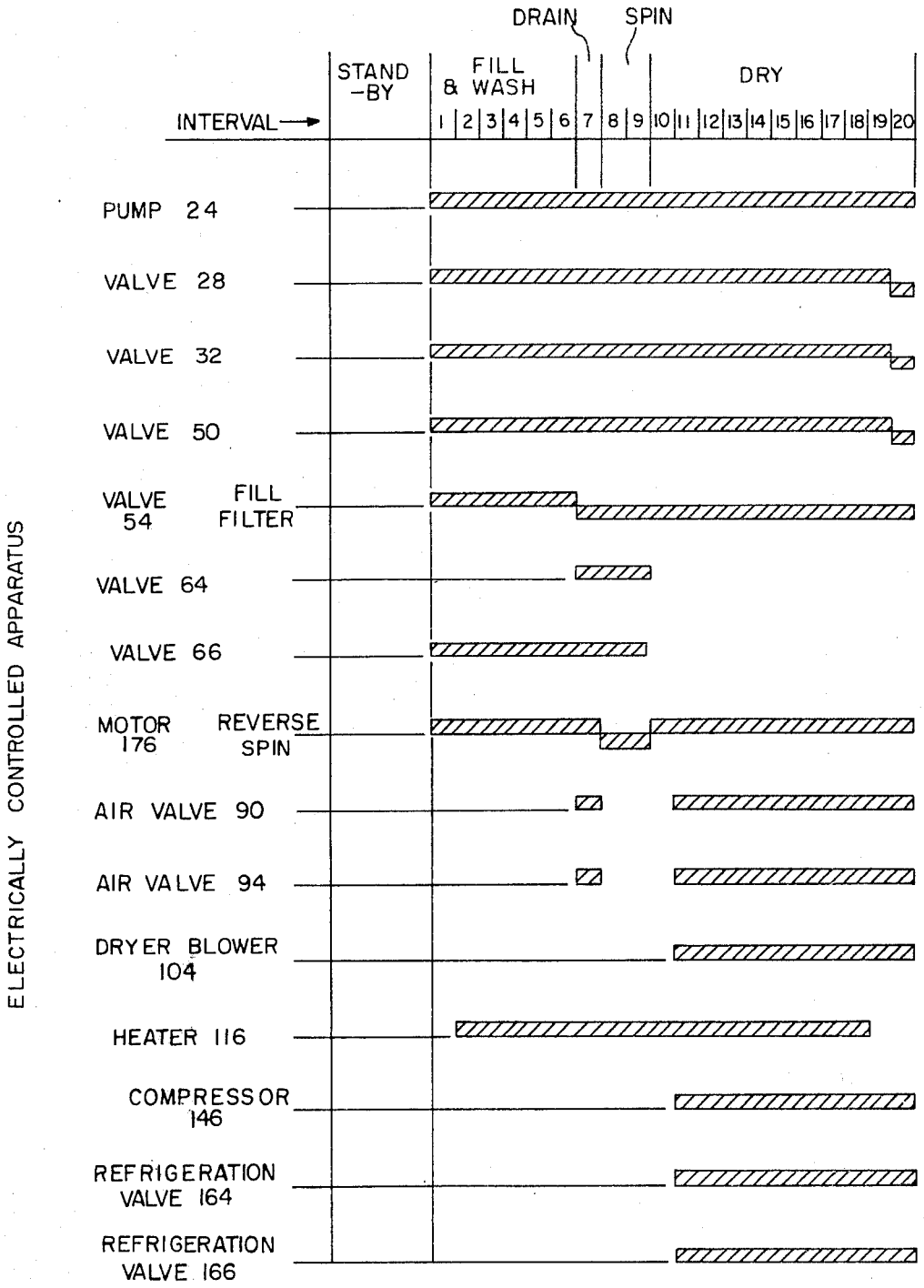
FIG. 3 is a timer cycle chart indicating the timer-energized components during each portion of the dry cleaning cycle; and, FIG. 4 is a simplified schematic wiring diagram showing the machine controls.

The air exits housing 108 through hose 112 which leads into a heater box 114 enclosing a cast aluminum finned resistance heater 116, where the temperatures of air is elevated to a predetermined level. (It is noted in FIG. 3 that the heater has been energized a sufficient length of time prior to the flow thereover to insure the heater is at the elevated temperature when the airflow through the tub 4 begins.) From the heater box 114 the heated air flows into inlet valve 90 and thence into the inlet of header 59 to flow through the clothes in the tub 4, vaporizing the solvent from the clothes and repeating the closed circulation path described continuously through the dry portion of the cycle. At the termination of the dry portion of the cycle the blower 16 stops, valves 90 and 94 close and the front opening access door is permitted to be electrically unlocked by manual depression of a door opening switch. (It should be pointed out that once the cycle has been initiated the door is mechanically locked in a manner that can only be unlocked through the electrical energization of a solenoid that is prevented from being energized until the cycle is complete and subsequently described with reference to FIG. 4.)

Clothes Removal

Once the dry portion of the cycle is completed as above described, the machine is no longer controlled by the timer but is in a stand-by condition ready to repeat a cleaning cycle. However, for removal of the clean clothes, the access door must be open. And, as previously explained, anytime the door is open an exhaust fan 120 is energized through a door switch 140 (see FIG. 4) along with exhaust valve 92, also energized through the door switch 140, being opened. Thus, air is forced to enter the front opening, flow directly into the header chamber 11, through valve 92 attached thereto and into the blower 120. From the blower the air flows through hose 122 which in turn is to be connected to a venting system for the building housing the dry cleaner.

The airflow with the door open is thus limited to an exit path that is exclusive for exhausting and does not cause air to flow through the interior of the tubs 4, 6 thus minimizing the loss of solvent vapor to the exhaust. Also, the exhaust, to satisfy established requirements, causes air to flow through the door opening at a minimum rate of 100 linear feet per minute.

SOLVENT VAPOR HANDLING (FIG. 2)

During the fill portion of the cycle, the air in the tubs 4, 6 is displaced by the incoming solvent. Also, the warmer surfaces of the tubs cause some of the incoming solvent to vaporize. The closed door prevents this vapor from escaping through it and with the valves 90 and 94 closed, the air/vapor mixture is forced (by pressure) into hose 96 leading to lint box 98.

An exit hose 124 leads from the lint box to an expandable closed impervious bag 126, preferably plastic and housed in a container (not shown) located in the upper portion of the machine. The bag expands to accommodate and retain the air-vapor mixture. This bag keeps the pressure within the machine within low enough limits such that positively sealing the machine against the existing pressure to prevent leakage does not become prohibitively expensive as it would if the solvent vapor remained in the confines of the tub and attached hoses. In practice the pressure within the machine tends to stabilize at approximately one-half psi as opposed to approximately ten psi without the bag.

A safety release valve 130 is interposed in line 124 and adjusted to open under a somewhat greater pressure than one-half psi to insure that the internal stays within an acceptably low limit. However, under most circumstances valve 130 will not be required to open.

During the wash portion of the cycle, the vapor pressure within the tubs and line 96 tends to stabilize so that there is minimal air/vapor movement. Also, during the dump portion of the cycle, even though valves 90 and 94 are open, there is very little air/vapor flow from the bag 126 as the increasing volume in the tubs decreases the vapor pressure which in turn permits more solvent to vaporize to fill this space. The valves 90 and 94 being again closed for the spin portion of the cycle prevent air/vapor flow from the bag.

However, during the dry portion of the cycle with valves 90 and 94 open, the air is circulated as previously described. It is noted that line 24 is on the suction side of recirculating blower 16 so that with the blower 16 energized, the air/vapor mixture in the bag, being at a greater pressure and at an elevated position with respect to the suction inlet to the blower, is forced back into the flow stream via the lint box 98, until the bag 126 is evacuated. The vapor in this air/vapor mixture is then recovered in the same manner as the vapor driven from the clothes during the drying operation is recovered. The bag is evacuated well before the termination of the drying operation.

The relatively warm ambient temperature causes some of the solvent in the storage tank 20 to vaporize. This vapor is removed from the tank (to prevent pressure buildup therein) by a breather line 128 leading to condenser box 108. As the air passage through the condenser box 108 is blocked by valves 90 and 94 during all portions of the cycle except drain and dry, the box 108 and the hoses connected thereto act like a chamber providing additional volume to accumulate and retain the vapors. However, during this time, should the pressure increase beyond an acceptable level, (i.e. somewhat less than one-half psi) the vapors can by this pressure, be forced through line 106, backwards (in relation to the normal direction of flow) through recirculating fan 16, into hose 102. This pressure is then on the back face of closed valves 94 which is oriented to prevent flow in the other direction, but with back-pressure thereon, opens sufficiently for the vapors to leak through it and into box 98. From there the vapors go through line 124 for retention in the expandable bag 126 for subsequent reclamation as previously described.

During the drain portion of the cycle, the vapors generated in the tank 20 and directed to the condenser housing 108 are permitted to flow through the heater box 114 and into the tubs 4, 6 through the then open valve 90 for subsequent reclamation during the dry portion of the cycle, whereas during the dry portion, when the evaporator 110 is operating, the vapors directed into the condenser box 108 from either the tub or the tank are condensed.

In addition to condensing solvent vapor, the evaporator 10 in the condenser housing also condenses water vapor evaporated from the clothes during the dry portion of the cycle. This water/solvent mixture is directed from the condenser housing 108 by gravity flow through line 134 to the water separator housing 136 where, because of the difference in the specific gravity between the two liquids, the solvent can be removed from the water by lines exiting the separator at different levels as is well known in the art. Thus, the water goes through the separator 136 through line 138 into a closed container 140 for intermittent manual dumping. The solvent exits the housing 136 through line 142 to return to the storage tank 20.

REFRIGERATION SYSTEM (FIG. 2)

Stand-by

A compression-type refrigeration system is provided in the dry cleaner for condensing the vapors in the condenser box 108 and also for maintaining the liquid solvent in the storage 20 at a predetermined temperature to minimize the vaporization therein. The system is best seen in FIG. 2 and operates to cool the storage tank under all portions of the cycle except the drying portion. Thus, the description for stand-by includes these other portions of the cycle.

Thus, whenever the thermostat 141 within the tank 20 exceeds a predetermined limit (80°F) the refrigeration unit is energized with cooling directed to the evaporator coil 144 in the storage tank 20. In the system shown the refrigerant flow path includes a compressor 146 with a compressed refrigerant directed therefrom through line 148 to refrigerant condenser 150, accumulator 152, filter 154 and sight-glass 156 to T-connector 158. Of the two lines 160 and 162 leading from the T-connector 158, line 160 contains a normally closed valve 164 which thus prevents flow therethrough. However, line 162 contains a normally open valve 166 permitting the refrigerant to flow into line 168 leading to expansion valve 170 and evaporator coils 144 in the storage tank 20. From there the refrigerant is directed back to the compressor 146 through line 172 and T-connector 174. Once the solvent in the tank has been cooled to around 75°F, the refrigeration system is deenergized, but ready to repeat the cycle whenever the temperature exceeds 80°F.

Dry

During the dry portion of the cleaning cycle the refrigeration unit is continuously energized through a switch 143 (See FIG. 4) controlled by the timer. At this time the refrigerant flow from the compressor 146 is identical to that described above until it reaches the T-connector 158. The flow path from there is altered by the normally closed valve 164 being energized to an open position and the normally open valve 166 being energized to a closed position. Thus, the refrigerant is directed into evaporater coil 110 of the condenser housing 108 for continuous condensing of the solvent vapors passing therethrough during this time, and maintaining a substantially fixed temperature therein over the varying load conditions. From there the refrigerant 146 passes through line 176 leading to T-connector 174.

It is noted that during the dry portion of the cycle, the temperature of the solvent in the storage tank 20 can exceed the 80°F temperature without refrigeration being directed thereto. However, as this dry portion is a relatively short-term operation, the temperature rise is never too much beyond the 80°F and also the increased rate of vaporization is accommodated through the breather line 128 directing the vapor to the condenser housing where it is condensed and returned to the storage tank, as previously explained, as relatively cool solvent.

Further, as the refrigeration unit is sized in accordance with the heat removal required of it during the drying portion of the cycle (this being the greatest load it must accommodate) its refrigeration capacity is greatly in excess of that needed to maintain the solvent within the predetermined temperature range during all other portions of the cycle. Thus an alternative refrigeration control system would be to eliminate the normally closed valve 164 in line 160 and make valve 166 (previously identical as being normally closed valve. In this arrangement, during all portions of the cleaning cycle except drying, the now normally closed valve 166 would be opened in response to the thermostat sensing a predetermined limit and the refrigerant would then flow into the evaporator coils 144 in the tank 20. As the refrigerant line to the evaporator coils 110 is also opened (because there is no valve) a portion of the refrigeration would also flow into it, however, because of the oversized capacity of the unit, sufficient refrigerant would flow to the coils 144 to cool the tank.

During the dry portion of the cycle, valve 166 would be prevented from being energized by the thermostat, and thus being a normally closed valve, would direct all the refrigerant into the coils 110 to condense the vapors in the circulating drying air. This last described system permits the elimination of one valve 164 from the previously described system.

Thus, the refrigeration system has a single compressor for alternatively primarily cooling two distinct evaporator coils under either a continuously timed demand for one coil or a cyclical temperature responsive demand for the other coil, with the time demand having precedent.

CONTROLS (FIG. 4)

As previously stated and as is well known in the art, the automatic dry cleaning machine is controlled for the most part through a timer mechanism 18 mounted in the back portion of the housing so as to be generally accessible to only certain personnel so that the cleaning cycle cannot normally be altered in any way.

However, in the present invention, provision is made for purposely altering the timer operation to provide what would normally be a dry portion of the cycle, but without rotating the tub or advancing the timer to other portions of the cycle. This modified dry operation is thus utilized to dry the filter cartridges, which must occasionally be replaced, prior to them being discarded to reclaim any residual solvent or solvent vapors therein that remain after the filters are removed from their housing 36 for replacement.

Normally, the proprietor would know when it was time to change the filters and would preferably allow the machine to remain quiescent for some period of time to permit solvent to gravitationally drain from the filters. However, as this does not remove all the recoverable solvent, the present machine permits the filters to be placed within the tub 4 and the control mechanism set to provide the above operation identified as "cartridge dry" on the timer control panel. To actuate the mechanism to this procedure, a switch (to be discussed) is included on the control panel having one switch arm serially connected in the timer motor circuit and another switch arm serially connected in the main motor circuit so that in the "cartridge dry" position of this switch, both motors are inactive. After placing the switch in this position, the timer is manually turned to any point in the dry portion of the cycle, thereby actuating all elements previously identified to accomplish a drying process within the machine. After some length of time sufficient to dry the cartridges, the cycle is manually terminated by turning the timer to an "off" position and returning the "cartridge dry" switch to the normal position, thereby readying the machine for further use by the customer.

Figure 4:
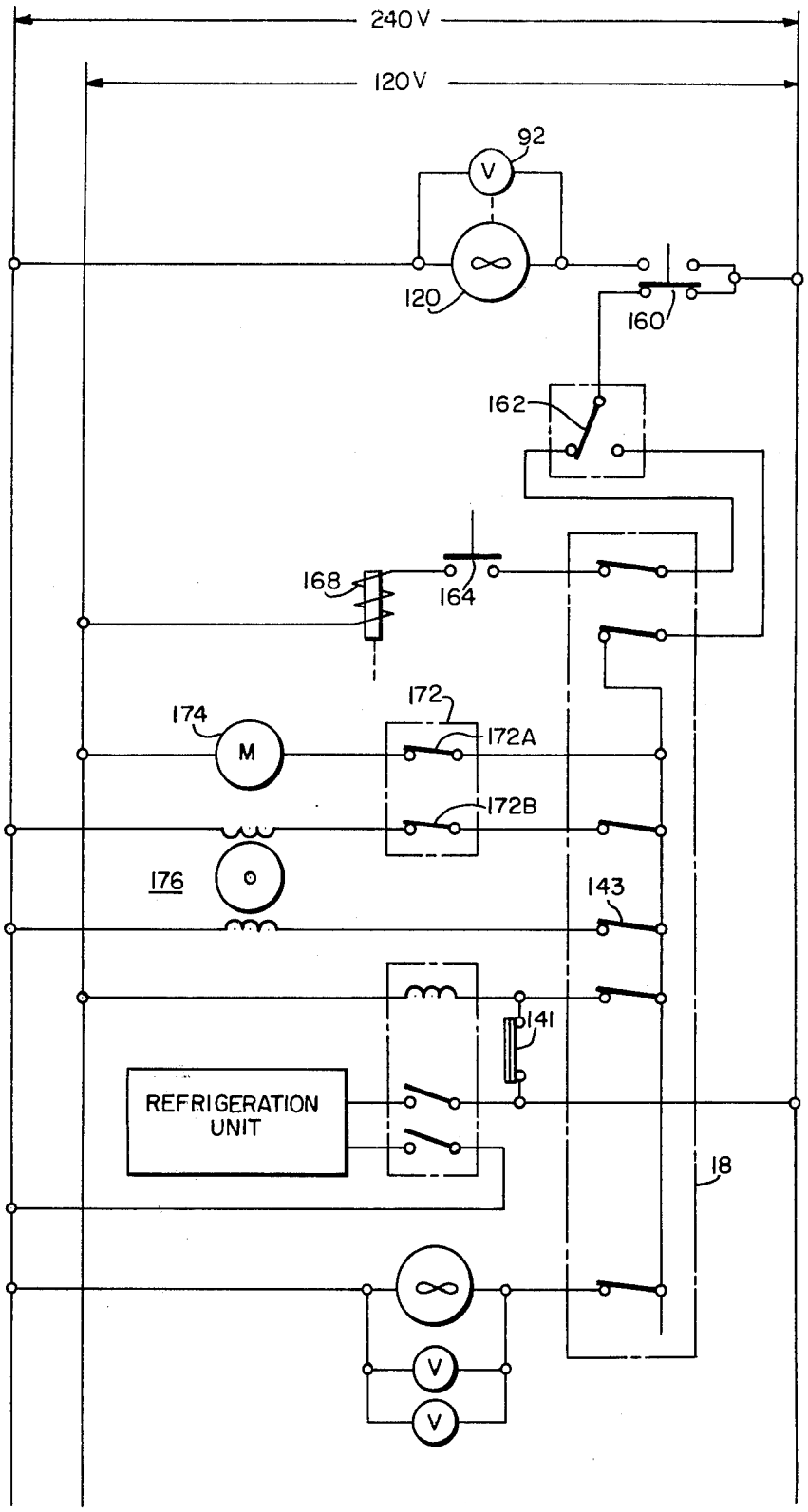

Reference is now made to FIG. 4 to briefly describe the controls of the machine and particularly those appliciable to the "cartridge dry" operation. Thus, it is seen that the control circuit includes a door switch 160 which, and the position shown, represents the access door being closed, and which is necessary for the machine to operate. It is noted that in the door open position, switch 160 would simultaneously energize the exhaust valve 92 and exhaust door 120 for air flow through the access opening as previously explained.

A control box switch 162 is in series with one side of the door switch and, in the position shown, indicates the termination of the cleaning cycle and thus the stand-by position. As the access door is mechanically locked, whenever closed, it can only be unlocked for acces when this switch 162 is in the position shown by manually depressing a door unlock switch 164 which energizes an unlocking solenoid 168.

Once coins are deposited to initiate the cleaning cycle, the control box switch moves to its other position to energize the appropriate timer contacts and deactivate the line having the door unlock switch 164 so that the door can no longer be unlocked.

The timer 18 as well known, includes a plurality of cam actuated switches (only certain ones being illustrated) with the controlling cams rotatingly driven by a timer advancing motor 174. Also, as can be seen, the main motor 176 of the machine is controlled through a timer switch. The "cartridge dry" switch 172 is interposed in each motor line so that when moved to the "cartridge dry" position, contact 172A to the timer motor is opened along with contact 172B to the tumble winding of the main motor (the tumble winding being the winding that is energized through the timer when the timer is positioned in the dry portion of the cycle) thus preventing either advancement of the timer mechanism or rotation of the inner tub 4. When it has been determined that the cartridges are dry, the machine is returned to the normal operating condition by closing switch 172 and returning the timer to the initiation point of the dry cleaning cycle.

We claim:

1. An improved intake air system for a dry cleaning machine having a cabinet, cabinet structure defining an opening in said cabinet, a stationary outer tub and a rotatable inner tub disposed within said cabinet, said tubs having common open ends in alignment with said opening in said cabinet, and door means hingedly attached with said cabinet for movement between an open and a closed position for effectively sealing said opening when in said closed position; and wherein the improvement comprises:

duct means interposed between said cabinet structure defining said opening and said common open ends of said tubs;

a normally off intake fan in communication with said duct means for drawing air therethrough when energized to an on condition;

a normally closed valve means between said duct means and said fan for controlling the flow through said duct means; and, means responsive to the movement of said door from said closed position to energize said fan and open said valve means whereby room air entering said opening immediately enters said duct means in a path which effectively excludes the interior of said tubs.

2. Structure according to claim 1 wherein said opening in said cabinet and said common open ends of said tubs are spactially separated and wherein:

said duct means is disposed in said spatial separation and defines a chamber having opposed wall members in sealing engagement with adjacent cabinet structure about the periphery of said cabinet opening and the open end of said outer tub respectively, each of said walls having an opening aligned with said cabinet opening and said tub open end respectively to provide a clothes passage from the exterior of said cabinet to the interior of said tub.

3. Structure according to claim 1 wherein said intake fan is utilized exclusively to draw air into said duct means through said opening in said cabinet.

4. Structure according to claim 3 wherein said ambient air flows into said opening in said cabinet at the rate of at least 100 linear feet per minute at any point in said opening.

* * * * *

UNITED STATES PATENT AND TRADEMARK OFFICE

CERTIFICATE OF CORRECTION

PATENT NO. : 3,978,694

DATED : September 7, 1976

INVENTOR(S) : John D. Hughes and Al W. Klingensmith

It is certified that error appears in the above-identified patent and that said Letters Patent are hereby corrected as shown below:

Column 11, line 3, "acces" should be --access--.

Column 12, line 31, "claim 1" should be --claim 2--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*